United States Patent [19]

Keefe

[11] 4,058,384

[45] Nov. 15, 1977

[54] PORTABLE REFRIGERATOR

[76] Inventor: Harry J. Keefe, 42 Clapboard Ridge, Danbury, Conn. 06810

[21] Appl. No.: 666,756

[22] Filed: Mar. 15, 1976

[51] Int. Cl.[2] ..... F25D 3/08; F25D 9/00

[52] U.S. Cl. ..... 62/457; 62/401

[58] Field of Search ..... 62/457, 401, 86

[56] References Cited

U.S. PATENT DOCUMENTS

| | | | |
|---|---|---|---|
| 198,830 | 1/1878 | Albertson | 62/401 |
| 1,893,171 | 1/1933 | Kagi | 62/401 |
| 3,823,559 | 7/1974 | Foret | 62/401 |
| 3,886,764 | 6/1975 | Edwards | 62/401 |
| 3,913,351 | 10/1975 | Edwards | 62/86 |
| 3,937,030 | 2/1976 | Jaspers | 62/401 |

*Primary Examiner*—Lloyd L. King

*Attorney, Agent, or Firm*—John J. Swartz

[57] ABSTRACT

Refrigerating apparatus including a portable container and a manually operated refrigerating system which is intermittently operated to extract air from the container, compress, cool, and expand the extracted air, and return the cooled expanded air to the container to maintain a predetermined low temperature within the container.

10 Claims, 4 Drawing Figures

PORTABLE REFRIGERATOR

BACKGROUND OF THE INVENTION

This invention relates to portable cooling apparatus and more particularly to a manually operated refrigerating system which will maintain low temperatures in a food storage container and more particularly to a cooling system which compresses, cools and expands the air within the container.

Conventionally, campers maintain food in a refrigerated condition, by a small, electrically operated, mechanical refrigerating system incorporating freon, or by means of a portable, chest type cooler utilizing ice.

Portable camping coolers are typically of such construction that approximately 20–50 B.T.U.'s per hour of heat, depending on the ambient temperature, wall thickness, et cetera, will pass to the inside of the cooler. Conventionally, refrigerated food is maintained at a proper temperature by placing it in the cooler along with a supply of ice. When the ice melts, the cooling is discontinued and the food warms rapidly unless additional ice is supplied. A conventional electrically operated refrigerating system limits the portability because of the constant requirement for electricity.

Such coolers are substantially useless to campers who camp in remote areas not accessible to ice or electricity. Such campers have a need for a cooling unit which can be manually operated to maintain a low temperature inside the cooler. It is also important that the camper can maintain refrigerating temperatures with a minimal of effort and time otherwise, the camper will not utilize the manually operable cooler.

Accordingly, it is an object of the present invention to provide apparatus for cooling a container in a remote area not accessible to electrical power and ice.

It is another object of the present invention to provide a portable food container having a manually operated compressor.

It is still a further object of the present invention to provide apparatus of the type described which will operate an air amplifier for cooling a heat exchanger in response to a portion of the compressed air extracted from the cooler.

Air conditioning systems conventionally available utilize a two phase refrigeration system which is relatively expensive and complicated. Conventionally, air conditioning systems utilize a refrigerant, such as freon, as one liquid phase to cool the air which is the other liquid phase. It is a further object of the present invention to provide apparatus of the type described including a compressor which extracts the air from the inside of a container, compresses the air and then passes the compressed air through a heat exchanger at a substantially constant pressure while reducing the temperature of the compressed air, expanding the air and reintroducing the cooled expanded air in the container.

It is still another object of the present invention to provide apparatus of the type described including a unitary compressor and expander unit in combination with a heat exchanger unit and a high flow, low suction air amplifying device for, cooling the compressed air which passes through the heat exchanger unit.

It is yet another object of the present invention to provide a method and apparatus of refrigerating a portable cooler by utilizing a portion of the compressed air extracted from the cooler to provide a large flow of cooling air for reducing the temperature of the remaining compressed air as it passes through a heat exchanger.

Other objects and advantages of the present invention will become apparent to those of ordinary skill in the art as the description thereof proceeds.

SUMMARY OF THE INVENTION

Refrigerating apparatus for a portable container for food and the like comprising a compressor for receiving and compressing warm air extracted from the container, a heat exchanger for receiving the warm air and reducing the temperature of the compressed air, mechanism coupled to the compressor and receiving a portion of the compressed air for producing a large flow of ambient air over the heat exchanger to cool the compressed air, and mechanism for expanding the air and communicating the cooled expanded air from the heat exchanger to the container.

The present invention may more readily be understood by reference to the accompanying drawings in which.

Figure 1:
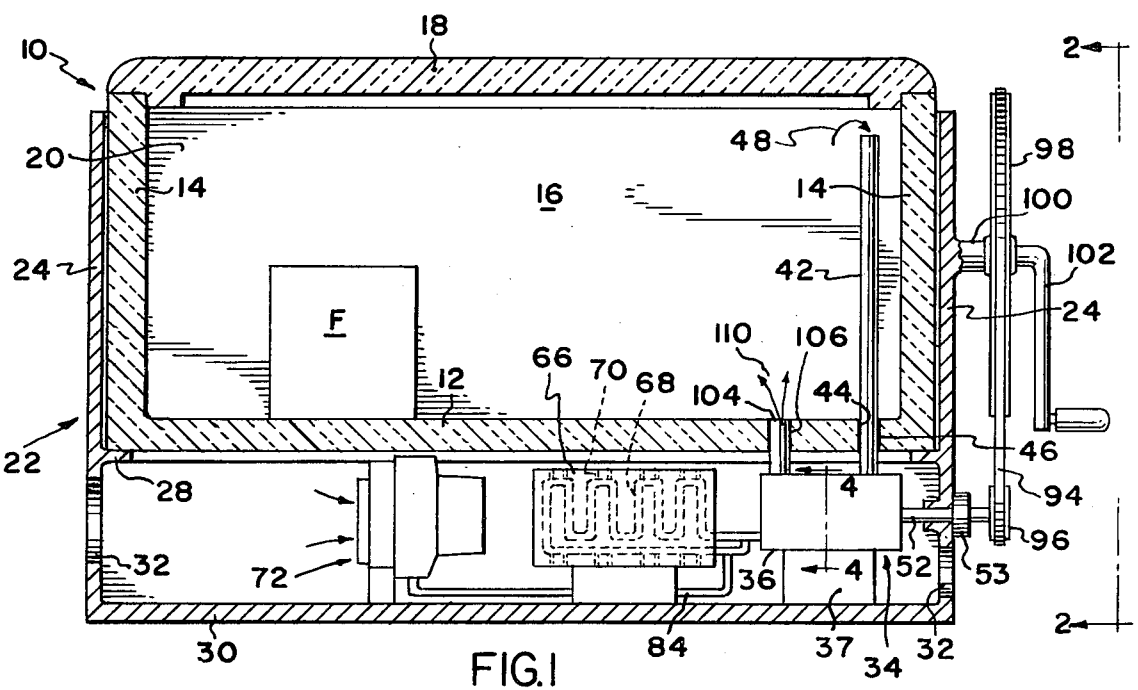
FIG. 1 is a side elevational sectional view of apparatus constructed according to the present invention taken along the line 1—1 of FIG. 2.

Apparatus constructed according to the present invention is particularly adapted for use in cooling an insulated food storage container, generally designated 10, including an insulated bottom wall 12, opposed end walls 14, opposed side walls 16, and a removable cover 18. The cover 18 can be removed such that already refrigerated food F can be placed in the chamber 20 defined by the walls 12, 14, and 16. Such containers are commercially available under the trademarks THERMOS and COLEMAN and are typically of such insulated construction that when the cover 18 is in place, as illustrated in FIG. 1, heat is transmitted to the cavity or chamber 20, at an approximate rate of 50 B.T.U.'s per hour. Accordingly, in order to maintain the temperature of the refrigerated material F within the cooler 10, it is necessary to remove heat from the chamber 20 at at least a rate of 50 B.T.U.'s per hour.

Apparatus constructed according to the present invention includes a frame, generally designated 22, comprising opposed end walls 24, and opposed side walls 26 having an inwardly disposed perimetrically extending flange or ledge 28 which supports the food storage container 10 in the position illustrated in FIG. 1. A bottom frame wall 30 spans the lower edges of the side and end frame walls 24 and 26. Openings 32 are provided in the end walls 24 for drawing in ambient air and exhausting air in a manner to become readily apparent.

Apparatus constructed according to the present invention includes a unitary compressor and expander unit, generally designated 34 which is more fully and completely described in U.S. Pat. No. 3,686,893, and granted Aug. 29, 1972, to Mr. Thomas C. Edwards, U.S. Pat. No. 3,686,893 is incorporated herein by reference as fully set forth herein. The compressor expander unit 34 is sold by Rovac Corporation, 109 Building, Candace Drive, Maitland, Fla., under the trademark ROVAC AIR Conditioning System and has been further described in the Rovac Corporation Publication, copyright 1973 which is incorporated herein by reference. The unitary expander and compressor unit 34 includes a stator 36 supported on the frame floor 30 via a stand 37 and defining an eliptical, axially extending stator chamber or cavity 38.

The stator 36 includes an inlet port 40 connected to an upstanding air extracting tube 42 which passes through an opening 44 in the bottom wall 12 of the food storage container 10. The air extracting tube 42 is sealed to the wall 12 via a suitable sealant 46 to minimize the transfer of warm air to the container. The hollow air extracting tube 42 receives warm air at the top of the chamber 20 and passes it downwardly in the direction of the arrow 48 to one side of the compressor expander unit elliptical cavity 38.

The compressor expander unit 34 includes a rotor, generally designated 50, mounted on a shaft 52 journalled for rotation in bearings 53 mounted on one of the frame end walls 24.

The rotor 50 includes a plurality of radially extending slots 54 which mount rotor vanes 56 for movement between radially inner positions, as illustrated at **56*a*, and radially outer positions as illustrated at 56*b*. The vanes are maintained in wipeing engagement with the stator wall 58** via cams as particularly described in said referenced patent. The rotor and stator cooperate to define a plurality of chambers C-1 through C-10.

Figure 2:
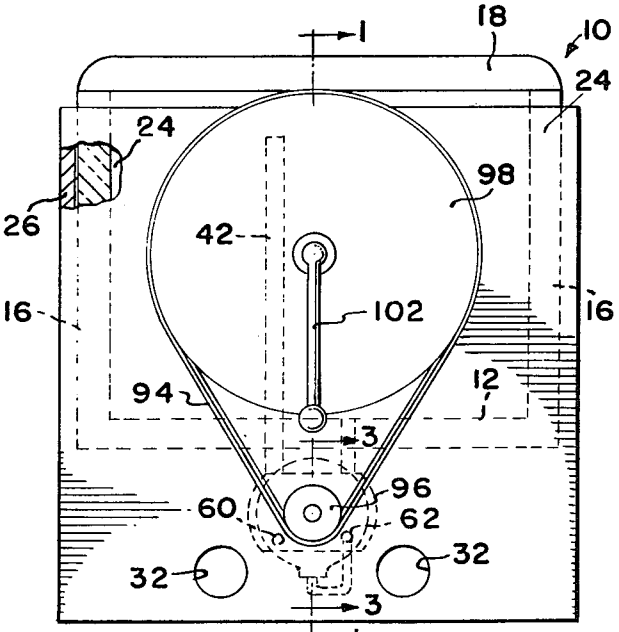
FIG. 2 is an end elevational view taken along the line 2—2 of FIG. 1.
Figure 4:
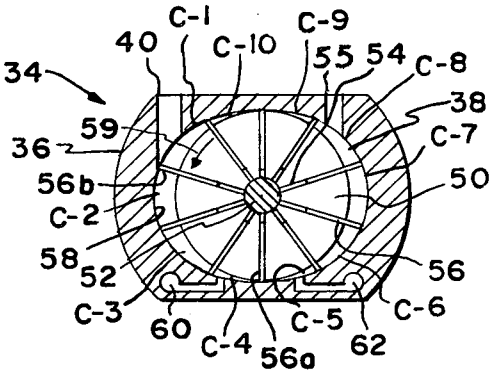
FIG. 4 is an enlarged, sectional end view taken along the line 4—4 of FIG. 1, illustrating the unitary compressor and expander.

As the rotor 50 rotates, the chambers C-1 through C-10 successively increase and decrease in capacity. The portion of the compressor expander unit on the left half of the apparatus illustrated in FIG. 4 comprises the compressor portion of the device and the apparatus illustrated on the right half of FIG. 4 comprises the expander portion of the device. As the rotor 50 turns counterclockwisely, as represented by the arrow 59 in FIG. 4, air is extracted from the cooler chamber 20 and drawn through the tube 42 into the compressioninlet chamber C-1. As the rotor motion continues, the chamber C-2 which is at maximum volume is filled and the air is now trapped and is then compressed by further rotation. The air, which is now trapped, is compressed by further rotation as illustrated in the chamber C-3. The stator 36 includes a compressed air outlet 60 communicating with chamber C-4 and a compressed, cool air inlet 62 communicating with chamber C-5.

A heat exchanger, generally designated 66, is provided for passing the compressed air between the stator compressed air outlet 60 and the stator compressed air inlet 62 via a hollow, cooled, metal line 68. The heat exchanger 66 includes heat radiating fins 70 which aids cooling of the compressed air in the air line 68. Ambient air is blown over the heat exchanger coil 68 and the fins 70 to cool the compressed air in the heat exchanger 66 in a manner to be presently described. The heat exchanger 66 may be constructed identical to the heat exchanger illustrated in the aforementioned patent which is incorporated herein by reference.

Figure 3:
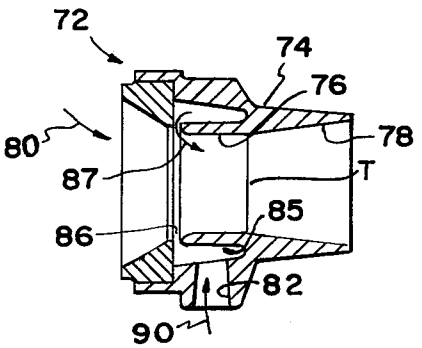
FIG. 3 is an enlarged, sectional, side elevational view taken along the line 3—3 of FIG. 2, illustrating the air flow amplifier.

Apparatus is provided for efficiently reducing the temperature of the compressed air in the heat exchanger 66 and includes an air flow amplifier generally designated 72. The air flow amplifier 72 includes a tubular or sleeve-like housing 74 (FIG. 3) having a cylindrical passage 76 therein opening into a passage 78 which flares radially outwardly in an axial direction and through which ambient air flows in the direction of the arrow 80. The housing 74 includes a high pressure air inlet 82 connected via a compressed air line 84 to the heat exchanger coil 68 for bleeding off a portion of the compressed air, as represented by the arrow 90. The air amplifier inlet 82 opens into an annular plenum chamber 85 provided in the air amplifier housing 74. A ring shaped slot 86 is provided in the housing 74 and opens into the chamber 85. The axial width, i.e. 0.002 inches, of the slot 86 is substantially restricted and represents a restriction to the compressed air represented by the arrow 90. The air is throttled to atmospheric pressure as it passes through the slot 86 and reaches sonic velocity, i.e. 1,000 feet per second as it moves in a radially inwardly direction represented by the arrows 87.

Immediately after leaving the slot 86, the air 87 flows along the inside of the cylindrical housing wall 76 and then moves axially downstream through the throat of the device and then along the outwardly flaring wall 78.

Many of the small particles of fast moving primary air 87 bump into still particles of air in the nozzle outlet region T causing the still particles to speed up and the fast particles to slow down. Thus, the primary stream 87 is sacrificing velocity to induce larger amounts of air 80 into the stream from the surroundings. A small suction is created in the nozzle outlet region T and an amplified flow moves through the throat T. In a perfect device, the mass flow could be amplified 100 times if the primary air were slowed down to 100 feet per second. This is because the kinetic energy, which remains constant, is one-half of the product of mass and the square of the velocity. Accordingly, modest sacrifices in the velocity of the primary air 87 produce tremendous amplifications of mass flow 80. The apparatus constructed according to the invention operates on what has been previously described as the Conada effect to produce a large flow of air 80 from a small primary flow of compressed air 90. An amplifier 72 is more particularly described in a publication of Vortec Corporation entitled "A Short Course on Transvector TM Air Flow Amplifiers With Application Notes"(which is copyright 1974 VORTEC CORPORATION, 4511 Redding Road, Cincinnati, Ohio 45229), which is incorporated herein by reference as though fully set forth herein.

The instant apparatus is to be distinguished from a venturi or an ejector. A venturi is merely a necked down section in a pipe with a pressure tap at the throat. A small reduced pressure is obtained at the throat due to the increased speed of the mainstream of fluid.

Ejectors are devices which discharge a small high speed of air or other fluid inside a conduit. This high speed jet entrains air from it surroundings and causes a larger flow of air to occur. Compared to the air amplifying device 72, ejectors are high suction, low flow devices.

The air amplifier 72 thus produces a large flow of air, as represented by the arrow 80, in response to a small primary flow of compressed air in the direction of the arrow 90. The large flow of air 80 over the heat exchanger 66 effects maximum cooling with minimum operation of the compressor expander unit 34.

By utilizing a small portion of the compressed air 90 and inducing a large flow of air 80, the air amplifying device 72 eliminates any need for an air circulating fan, motor, drive, chain, sprockets which cause wear, are expensive and would burden the user down with extra weight.

The compressor rotor 50 is driven via a drive belt 94 trained around a pulley 96 fixed to one end of the drive shaft 52 and a pulley 98 journalled on a crank shaft 100 mounted on one of the container end walls 24. A manually operated hand crank 102 is provided for driving the pulley 98 which in turn drives the belt 94 and the compressor rotor 50.

Although the unit is designed for manual operation, an optional small electric motor (not shown) can be provided to cycle the cooler automatically if electrical power is available, as in the case in most camp sites visited by campers. Continued operation of the system would remove enough B.T.U.'s of heat to effect freezing of water and make ice cubes, if desired.

After the air extracted from the container is cooled in the heat exchanger 66, it is readmitted to the stator inlet 62 to the chamber C-5. Upon continued rotation of the rotor, the compressed air is expanded through the chambers C-6 to C-8 at which point it is exhausted through a stator outlet port 55 communicating with chamber C-8. The port 55 is coupled to a discharge outlet 104 provided in the bottom wall 12 of the container 10. The tube 104 is sealed to the bottom wall 12 via a suitable sealant 106 to minimize warm air to the container Chamber 20. When the air expands through chambers C-6 to C-8, the air is substantially cooled to substantially reduce the temperature of the air. The temperature of the cold air as represented by the arrow 110, returned to the container chamber 20, is substantially less than the temperature of the air withdrawn from the upper end of the chamber, as represented by the arrow 48.

The apparatus constructed according to the present invention can be used by a person in the field, a person on a remote beach and can indefinitely maintain a low temperature to refrigerate and preserve food. The system is so designed that the handle 102 need only be cranked approximately two minutes to provide a sufficient refrigerating effect to maintain the temperature within the chamber 20 for approximately one hour.

With apparatus constructed according to the present invention, a refrigerating temperature can be maintained indefinitely with reasonable effort by a camper. More than one temperature can be maintained within the container to either hold food at a given temperature or to reduce the temperature sufficiently to make ice cubes. The refrigerated air is dry and therefore there is no water accumulation in the cooler whereas water resulting from melted ice acts as an excellent culture for bacteria growth in a conventional ice cooled coolers.

THE OPERATION

A camper will carry the cooler unit 10 containing prerefrigerated food to a remote area not accessible to ice or electricity. The camper will turn the crank handle 102 for approximately 2 minutes once each hour to effect a heat transfer of 50 B.T.U.'s which will maintain the internal temperature for approximately 1 hour. When the crank handle 102 turns the compressor expander unit 34 draws or sucks warm air out of the top of cavity 20, as illustrated by the arrow 48, into compressor cavity C-1. The compressor rotor turns and entraps the air in chamber C-2 and further compresses the air to a reduced volume chamber C-3. As the air is compressed, the temperature of the air increases. The heated, compressed air passes through stator outlet 60 through heat exchanger line 68. A portion of the compressed air is bled off at 84 and drives the air amplifier 72 which effects a large flow of ambient air to pass in the direction of the arrow 80 over the heat exchanger line 68.

The ambient air cools the compressed air in the heat exchanger line 68. As the cool air returns to the stator cavity chamber C-6 and passes to the enlarged chamber C-8, the air expands and substantially cools so as to be readmitted to the cooler chamber 20 via air return conduit 104 at a substantially reduced temperature. At the end of the two minute cranking time, the temperature inside the chamber 20 will be reduced to a range of 0° to 10° F, for example, far below the refrigerated temperature of 38° F to 45° F. The temperature of chamber 20 will, at the end of 1 hour, gradually increase to 38° F, for example. When the temperature reaches this level, the operator will again turn the crank for 1 to 2 minutes.

If desired, the camper can turn crank handle 102 for a sustained period of time and the temperature within chamber 20 will be reduced sufficiently to freeze water for ice cubes and the like.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for cooling air following removal of the air from a portable food storage container or the like and prior to recirculation of the air through said container comprising:

air outlet means for communicating air at a predetermined temperature from said container and air inlet means for communicating cooled air at a lesser temperature to said container;

compressor means connected to said air outlet means for receiving air from said container and compressing the removed air to heat the removed air;

heat exchanger means receiving a flow of compressed air from said compressor means and reducing the temperature of said compressed air;

high flow, low suction, air amplifying means, responsive to a small primary flow of compressed air for driving a relatively large flow of ambient air over said heat exchanger means to cool said compressed air;

means for mounting said compressor means, said heat exchanger means, and said amplifier means on said container; and conduit means connected to said inlet means and said air amplifying means for returning cooled air from said heat exchanger means to said inlet means to cool said container.

2. The apparatus as set forth in claim 1 wherein expander means is connected in circuit with said heat exchanger means and said conduit means for receiving compressed cooled air from said heat exchanger means and permitting said air to expand and be returned to said container.

3. The apparatus as set forth in claim 3 wherein said compressor means and said expander means are unitary, said heat exchanger means having an inlet port connected to said compressor means and an outlet port connected to said expander means, said compressor means including an air intake port connected to said outlet means and said expander means including an exhaust port connected to said conduit means.

4. The apparatus as set forth in claim 2 wherein said compressor means and said air expander means collectively comprise a stator including a cavity having a noncircular cross section;

a rotor rotatably mounted in said cavity;

a plurality of circumferentially disposed, vanes movable between radially inner and outer positions so as to be in sliding contact with the wall of said cavity whereby a plurality of separate chambers are formed inside said stator cavity, said chambers being adapted to successively increase and decrease in capacity upon rotation of said rotor.

said air outlet means communicating with one of said chambers;

another of said chambers being sealed and adapted to compress air therewithin upon rotation of the rotor;

another of said chambers communicating with said heat exchanger means to supply compressed air to said heat exchanger means;

another of said chambers communicating with said heat exchanger means to receive compressed air from said heat exchanger means; and another of said chambers communicating with said air inlet means.

5. The apparatus as set forth in claim 2 wherein said compressor means and said expander means collectively comprise a stator having a substantially eliptical, axial cavity and an air supply port for receiving and communicating air at said predetermined temperature to said cavity and a first air discharge port for discharging compressed air from a circumferentially displaced portion of said cavity; a circumferentially disposed, second air intake port connected to said heat exchanger means for receiving compressed air after the temperature thereof is reduced by said heat exchanger means;

said stator including a second discharge port, connected to said air inlet means for directing expanded, refrigerated air to said container;

a cylindrical rotor mounted for rotation in said cavity such that an air receiving chamber is provided adjacent said inlet port and a reduced volume chamber is provided adjacent said discharge port;

a plurality of circumferentially arranged vanes mounted on said rotor for movement between radially retracted and radially extended positions; and means for moving said vanes between said retracted and extended positions as said rotor rotates to maintain said vanes in wiping engagement with the stator.

6. Refrigerating apparatus for cooling air in a portable food storage container following removal of the air from the container and prior to recirculation of the air to said container comprising:

fluid outlet means for extracting air at a predetermined temperature from said container and fluid inlet means for communicating refrigerated air at a lesser predetermined temperature to said container;

compressor means connected to said fluid outlet means for receiving air from said container and compressing the removed air;

heat exchanger means for receiving compressed air from said compressor means and reducing the temperature of said compressed air when ambient air is passed over said heat exchanger means;

means for mounting said compressor means and said heat exchanger means on said portable container for movement therewith;

means coupled to said compressor means for receiving a portion of said compressed air to provide a flow of compressed air;

means responsive to said flow of compressed air for producing a relatively large flow of ambient air over said heat exchanger means; and conduit means connected to said heat exchanger means and said inlet means for communicating cooled air from said heat exchanger means to said inlet means to cool said container.

7. The apparatus as set forth in claim 6 wherein said means for producing a flow of ambient air includes bleeding means for bleeding off said portion of the compressed air on the downstream side of the compressor to produce a relatively small flow of compressed air.

8. The apparatus as set forth in claim 6 including expander means coupled to said heat exchanger means and said inlet means for permitting compressed, cooled air to expand and produce a refrigerating effect prior to passing to said inlet means;

said air flow producing means comprising an air flow unit for inducing said relatively large flow of air in response to said relatively small flow of compressed air, and means is provided for bleeding off a portion of the compressed air on the downstream side of said compressor means to provide said small flow of compressed air to drive said air flow unit.

9. Refrigeration apparatus for a portable container for food and the like comprising unitary air compressor means for compressing air, at a predetermined temperature, received from said container and air expander means for permitting compressed air to expand and be returned to said container at a lesser temperature;

a heat exchanger having an inlet port connected to one side of said unitary means and an outlet port connected to another side of said unitary means;

air directing means, responsive to a small flow of compressed air, for directing a relatively large flow of air over said heat exchanger to cool the compressed air therein; and bleeder means connected to said compressor means and said air directing means for bleeding off a portion of the air compressed by said compressor means to provide said small flow of compressed air to operate said air directing means.

10. A method of refrigerating comprising the steps of removing air having a predetermined temperature from a container to be cooled;

compressing the removed air to elevate the temperature thereof;

passing the compressed air through a heat exchanger to reduce the temperature thereof;

bleeding off a portion of the compressed air to produce a flow of air;

utilizing the bled off portion of said compressed air to produce a relatively larger flow of ambient air and directing the larger flow of ambient air over said heat exchanger to cool said compressed air; and expanding the cooled compressed air and returning the expanded air to said container.

* * * * *